US009983549B2

(12) United States Patent
Winkler et al.

(10) Patent No.: US 9,983,549 B2
(45) Date of Patent: May 29, 2018

(54) ISOCHRONOUS TIMEPIECE RESONATOR

(71) Applicant: ETA SA Manufacture Horlogere Suisse, Grenchen (CH)

(72) Inventors: Pascal Winkler, St-Blaise (CH); Jean-Luc Helfer, Le Landeron (CH); Gianni Di Domenico, Neuchatel (CH); Thierry Conus, Lengnau (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days. days.

(21) Appl. No.: 15/309,094

(22) PCT Filed: Jan. 26, 2016

(86) PCT No.: PCT/EP2016/051486
§ 371 (c)(1),
(2) Date: Nov. 4, 2016

(87) PCT Pub. No.: WO2016/124436
PCT Pub. Date: Aug. 11, 2016

(65) Prior Publication Data

US 2017/0123380 A1 May 4, 2017

(30) Foreign Application Priority Data

Feb. 3, 2015 (EP) ..... 15153656

(51) Int. Cl.
*G04C 3/08* (2006.01)
*G04B 5/04* (2006.01)

(52) U.S. Cl.
CPC . *G04C 3/08* (2013.01); *G04B 5/04* (2013.01)

(58) Field of Classification Search
CPC . G04C 3/08; G04C 3/102; G04B 5/04; G04B 5/10
See application file for complete search history.

(56) References Cited

U.S. PATENT DOCUMENTS 3,192,702 A 7/1965 Kato et al.
3,277,394 A 10/1966 Holt et al.
(Continued)

FOREIGN PATENT DOCUMENTS

CH 7571/65 9/1967
CH 451 021 5/1968
(Continued)

OTHER PUBLICATIONS

International Search Report dated May 13, 2016 in PCT/EP16/051 486 filed Jan. 26, 2016.

*Primary Examiner* — Sean Kayes
(74) *Attorney, Agent, or Firm* — Oblon, McClelland, Maier & Neustadt, L.L.P.

(57) ABSTRACT

A watch including a movement including itself an isochronous timepiece oscillator mechanism including a fixed support bearing a crosspiece carrying N primary resonators each including a weight carried by a rotating flexible bearing fixed to this crosspiece. Each primary resonator has a center of mass which, at rest, is on the virtual pivot axis of its rotating flexible bearing and is arranged to oscillate in rotation about this virtual pivot axis. The primary resonators are arranged in rotational symmetry of order N about a main axis parallel to the virtual pivot axes, and oscillating motions of any two primary resonators are phase shifted by the value of the central angle formed by their respective virtual pivot axes with the main axis.

19 Claims, 13 Drawing Sheets

(56) References Cited

U.S. PATENT DOCUMENTS

| | | | | |
|---|---|---|---|---|
| 3,318,087 | A | 5/1967 | Favre | |
| 3,447,311 | A | 6/1969 | Beyner et al. | |
| 3,515,914 | A | 6/1970 | Steinemann | |
| 3,548,585 | A | 12/1970 | Chopard et al. | |
| 9,465,363 | B2 * | 10/2016 | Winkler | G04B 17/04 |
| 9,477,205 | B2 * | 10/2016 | Born | G04B 17/045 |
| 9,536,175 | B2 * | 1/2017 | Cho | G06F 17/30247 |
| 2016/0179058 | A1 * | 6/2016 | Born | G04B 17/045 368/167 |
| 2016/0223989 | A1 * | 8/2016 | Winkler | G04B 17/04 |
| 2017/0010586 | A1 * | 1/2017 | Di Domenico | G04B 17/045 |

FOREIGN PATENT DOCUMENTS

| | | |
|---|---|---|
| CH | 466 993 | 2/1969 |
| FR | 1605076 | 1/1973 |
| GB | 1 293 159 | 10/1972 |

* cited by examiner

A1
A2
CM1
CM2
CM
B
C
D
2
3
4
5
30
41
42
45
49
51
52
55
57
59
61
62
71
72
73
74
75
76
77
78
79
93

51
54
4
2
30
3
54
52

51
CM1
C
Y
D
52
CM2
X
C
D 52
4
54
82

41
81
2
30
3
4
82
42

54

B
B 5
52
CM2

88
89
45
82
CM2

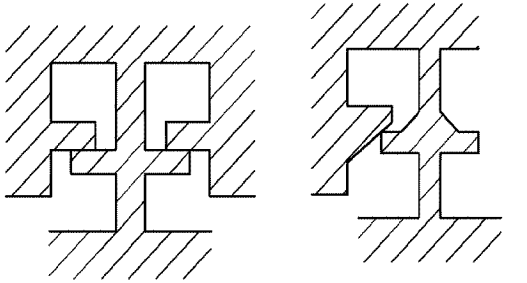
Fig. 13
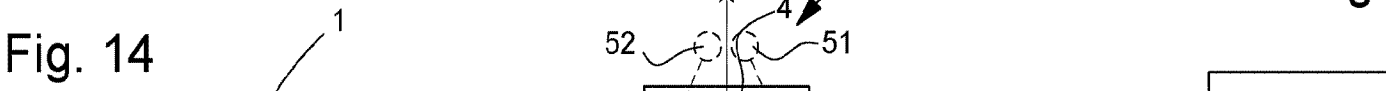
Fig. 14
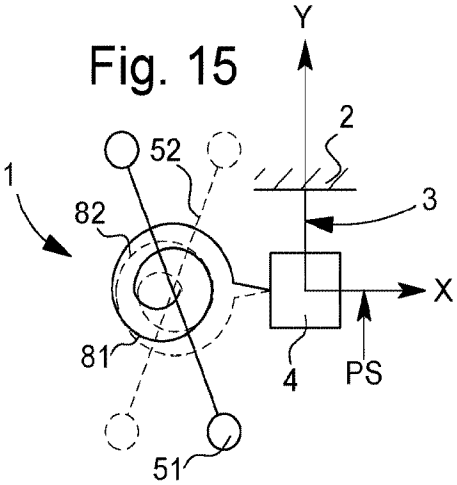
Fig. 15
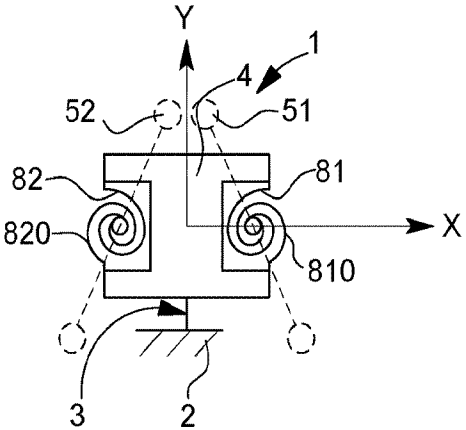
Fig. 16
Fig. 17
Fig. 18
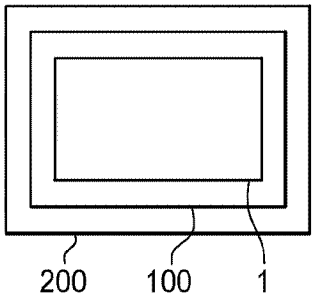
Fig. 22

ISOCHRONOUS TIMEPIECE RESONATOR

CROSS-REFERENCE TO RELATED APPLICATIONS

This is a National phase application in the United States of International patent application PCT/EP2016/051486 filed Jan. 26, 2016 which claims priority on European patent application 15153656.2 filed Feb. 3, 2015. The entire disclosures of the above patent applications are hereby incorporated herein by reference.

FIELD OF THE INVENTION

The invention concerns an isochronous timepiece oscillator mechanism, comprising a fixed support which bears a crosspiece carrying a plurality of N primary resonators each including at least one weight carried by a rotating monolithic articulated structure or flexible bearing fixed to said crosspiece.

The invention also concerns a timepiece movement comprising at least one such isochronous oscillator mechanism.

The invention also concerns a watch including at least one movement of this type.

The invention concerns the field of oscillator and regulating mechanisms for timepieces, in particular for mechanical movements.

BACKGROUND OF THE INVENTION

In a conventional mechanical watch, air friction on the balance wheel, the friction of the pivots in their bearings and the reaction forces of the balance spring stud limit the quality factor of the resonator. It is sought to eliminate pivot friction and the forces of reaction at the point of attachment.

In a watch, the watch movement must have optimal isochronism in all positions in space, which involves designing movements capable of compensating for the effects of gravity on their components.

Prior art documents describe oscillators comprising several primary resonators having flexible branches, arranged with respect to each other such that their errors are averaged out.

A first type of oscillator with coupled primary resonators is known in the form of a U-shaped tuning fork wherein each branch is formed by a primary resonator; however, this system is very sensitive to changes of position in space.

CH Patent 451021 in the name of Ebauches SA thus describes a symmetrical U-shaped oscillator with two flexible branches that vibrate in tuning fork mode, each being connected to a stiff arm forming a counterweight, and each primary resonator thereby formed is arranged such that the instantaneous centre of rotation coincides with the centre of gravity, such that the oscillator frequency hardly varies when the position of the centre of gravity changes. Changing to a U-shaped design with extended branches proves better than the U-shape of the prior art. However, the instantaneous centre of rotation moves continuously during the oscillation of each primary resonator.

CH Patent 46203, also in the name of Ebauches SA is a variant of the preceding Patent, comprising a counting device that transforms the oscillating motions of one of the two resonators into rotating motions of a counting wheel; the counting device is attached to one of the stiff arms, such that the counting device is not affected by accelerations and particularly by shocks.

GB Patent 1293159 in the name of SEIKO develops a theory based on the effect on rate regularity of the displacement derivative of the centre of mass with respect to the angle of rotation, and attempts to obtain a straight line displacement of the centre of mass of each primary resonator, to optimise the effect on rate. To this end, the centre of mass is positioned two thirds of the way along the flexure strip used in this system, in order theoretically to cancel out the effect on rate in vertical positions. However, the centre of mass moves a great deal, and this system is still sensitive to shocks. Further, this theory is based on a geometric approximation, since in reality the deflected shape of the flexible strip is no longer really an arc of a circle, and the assumed rectilinear displacement of the centre of mass is not confirmed.

U.S. Pat. No. 3,192,702A in the name of Yoshiaki Kato discloses a mechanical oscillator for a time base, with two symmetrical resonators coupled on either side of a core from which each is suspended by a flexible strip.

FR Patent Application 1605076A in the name of the Straumann Institute discloses a mechanical oscillator with a torsion bar forming the elastic element. The ends of this bar bear weights having the same moment of inertia with respect to the axis of the bar which has median symmetry, such that the oscillations of one half of the bar are transmitted to the other half, with the ends oscillating in phase opposition.

U.S. Pat. No. 3,277,394A in the name of William Holt discloses a temperature compensated electromechanical resonator, with two rings oscillating in phase opposition.

U.S. Pat. No. 3,318,087A in the name of Robert Favre, Movado, discloses a torsional oscillator, with a spring delivering a torque, integral with a frame and an oscillating weight, and cut to release elastic elements perpendicular to its torsional axis, arranged and dimensioned to work substantially by bending.

SUMMARY OF THE INVENTION

The invention proposes to overcome the problem of isochronism together with that of obtaining the best possible quality factor. In a way, this involves combining the respective advantages specific to known mechanisms that use, as a resonator, either a sprung balance assembly which, in its most advanced development and arrangement, has relatively low sensitivity to changes of position in space, but whose quality factor is greatly limited by the pivots and various losses, or a tuning fork with parallel strips which, by dispensing with pivots, has a better quality factor than a sprung balance, but is very sensitive to position in space.

To this end, the invention concerns an isochronous timepiece oscillator mechanism according to claim 1.

The invention also concerns a timepiece movement comprising at least one such isochronous oscillator mechanism.

The invention also concerns a watch including at least one movement of this type.

BRIEF DESCRIPTION OF THE DRAWINGS

Other features and advantages of the invention will appear upon reading the following detailed description, with reference to the annexed drawings, in which.

the effect of gravity on a first weight suspended towards the top via a flexible strip, and the rate diagram for a losing rate of a certain value, the effect of gravity on a second identical weight suspended towards the bottom via an identical flexible strip, and the rate diagram corresponding to a gain in rate of a certain value, the effect of gravity on a mechanism according to the invention which combines the two preceding mechanisms, and the rate diagram for virtually no error.

Figure 3:
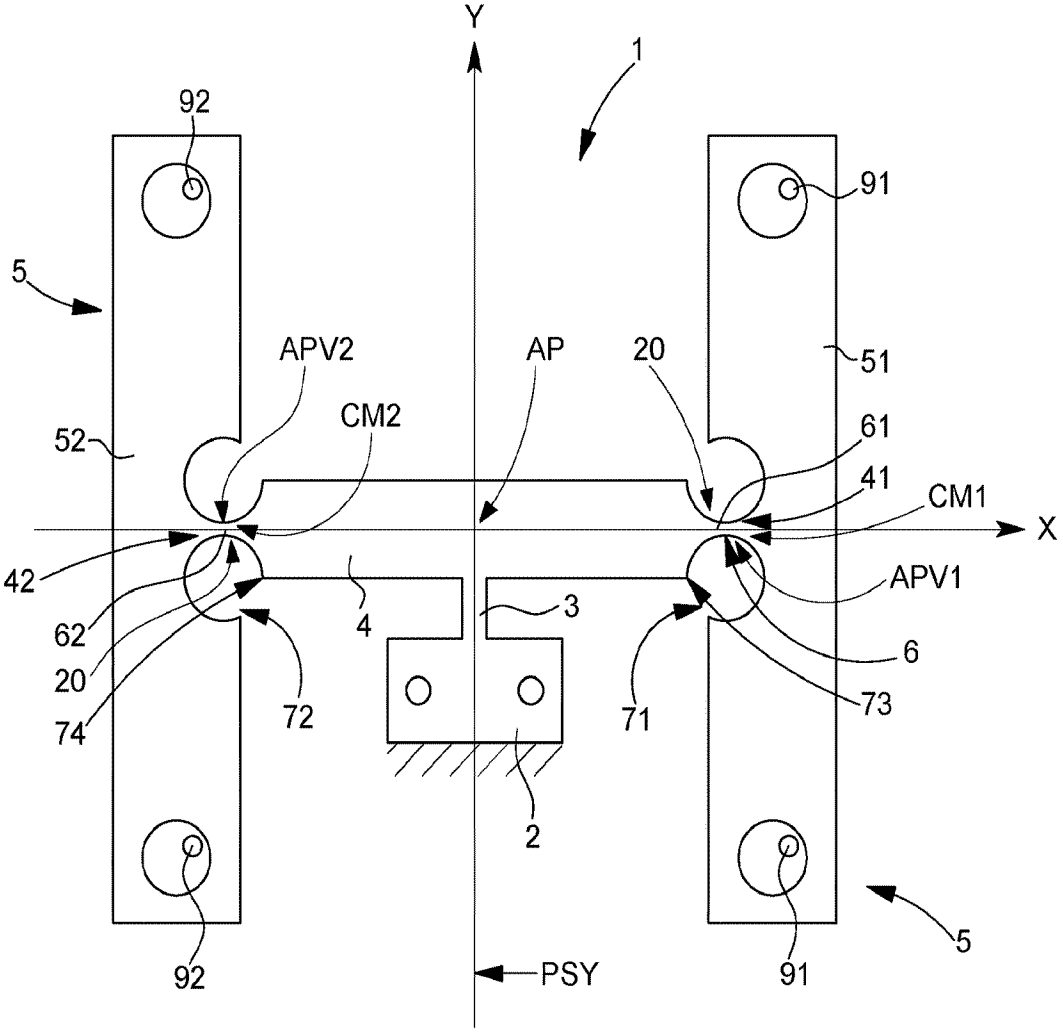

FIG. 3 shows a schematic plan view of a simplified version of a first embodiment of the invention, called the "H-shaped tuning fork".

Figure 4:
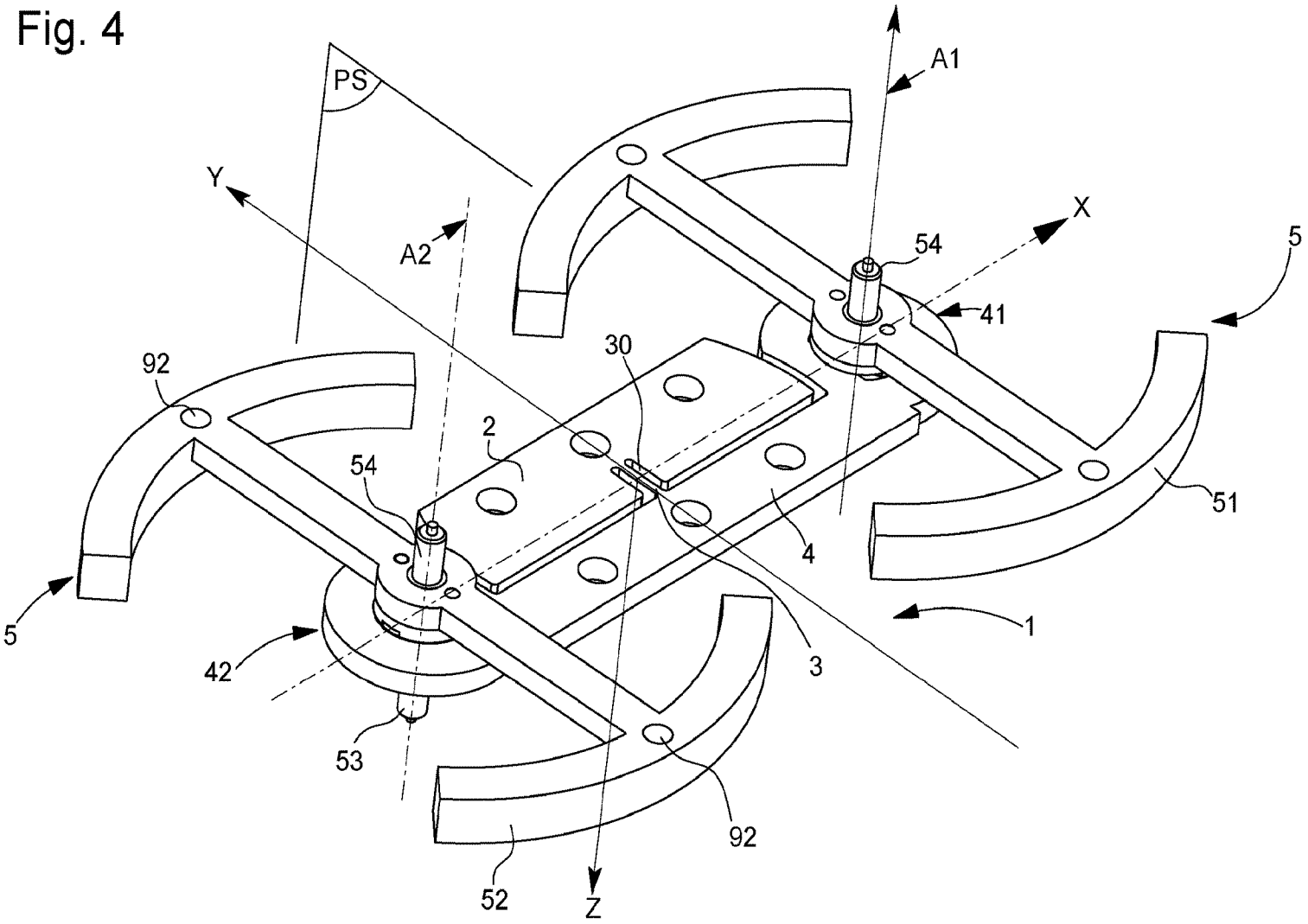
Figure 5:
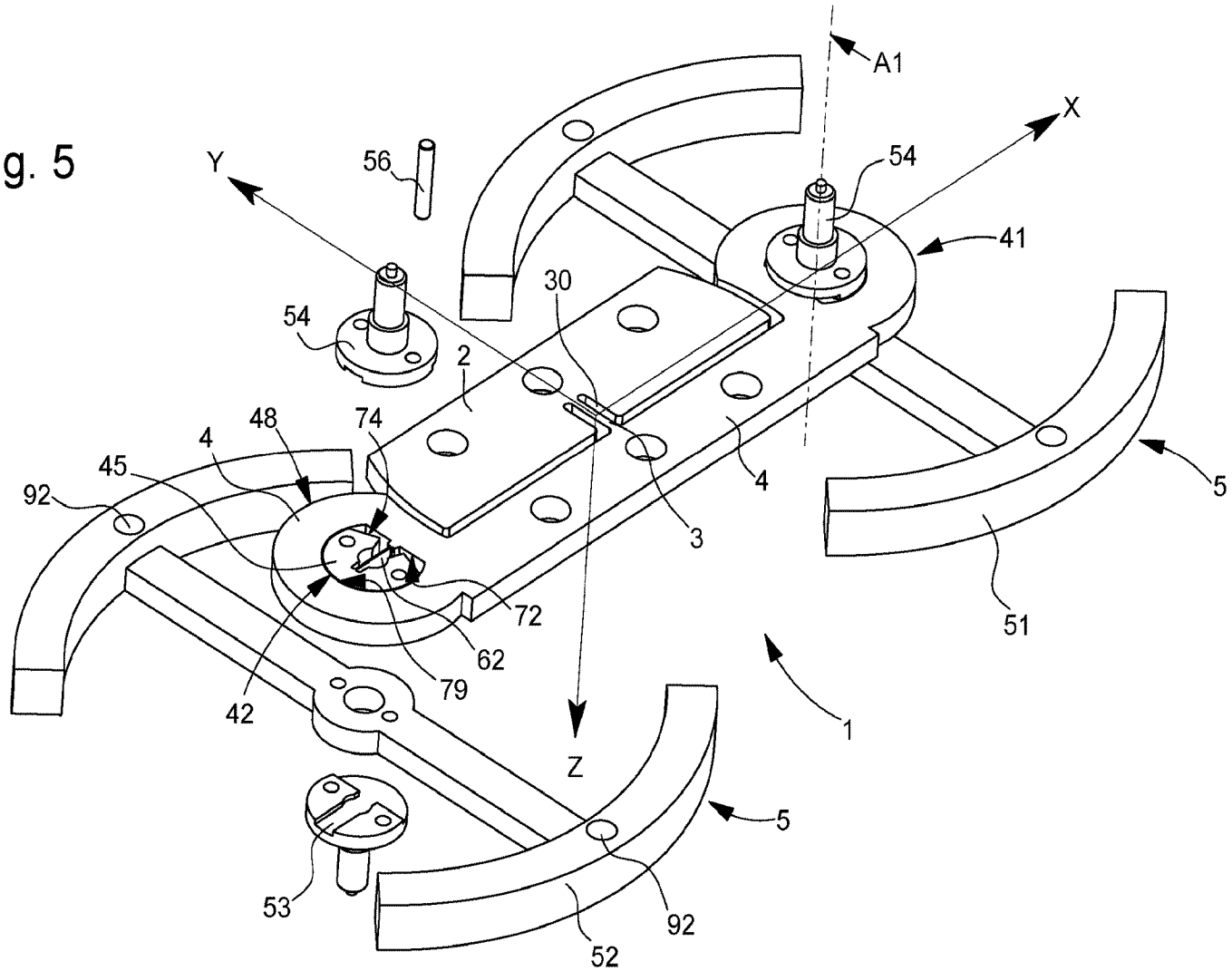

FIG. 4 shows an exploded schematic perspective view of a more advanced variant of the H-shaped tuning fork represented in FIG. 5.

Figure 6:
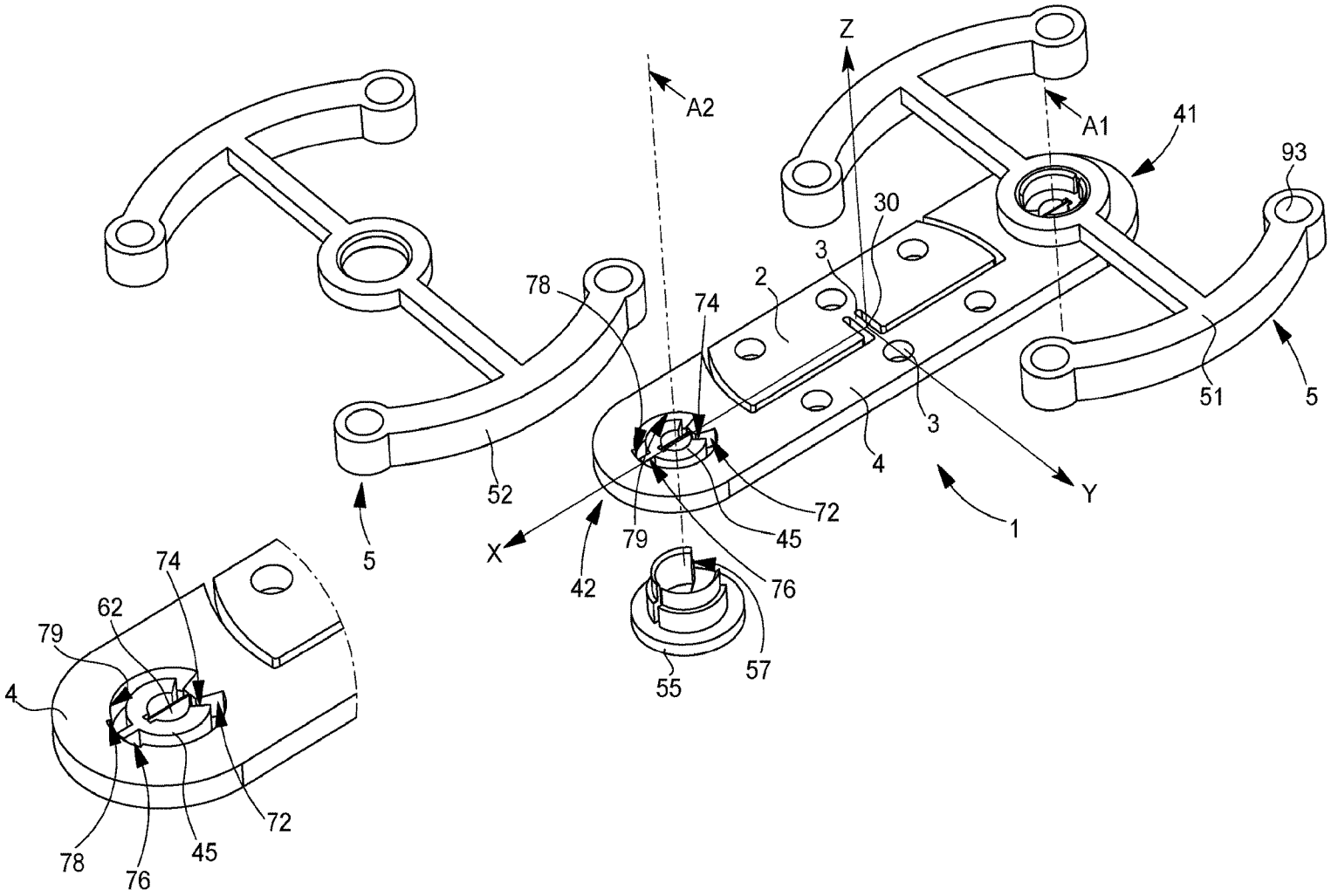
Figures 7A, 7B, 7C, 7D, 7E, 7F, 7G, 7H:
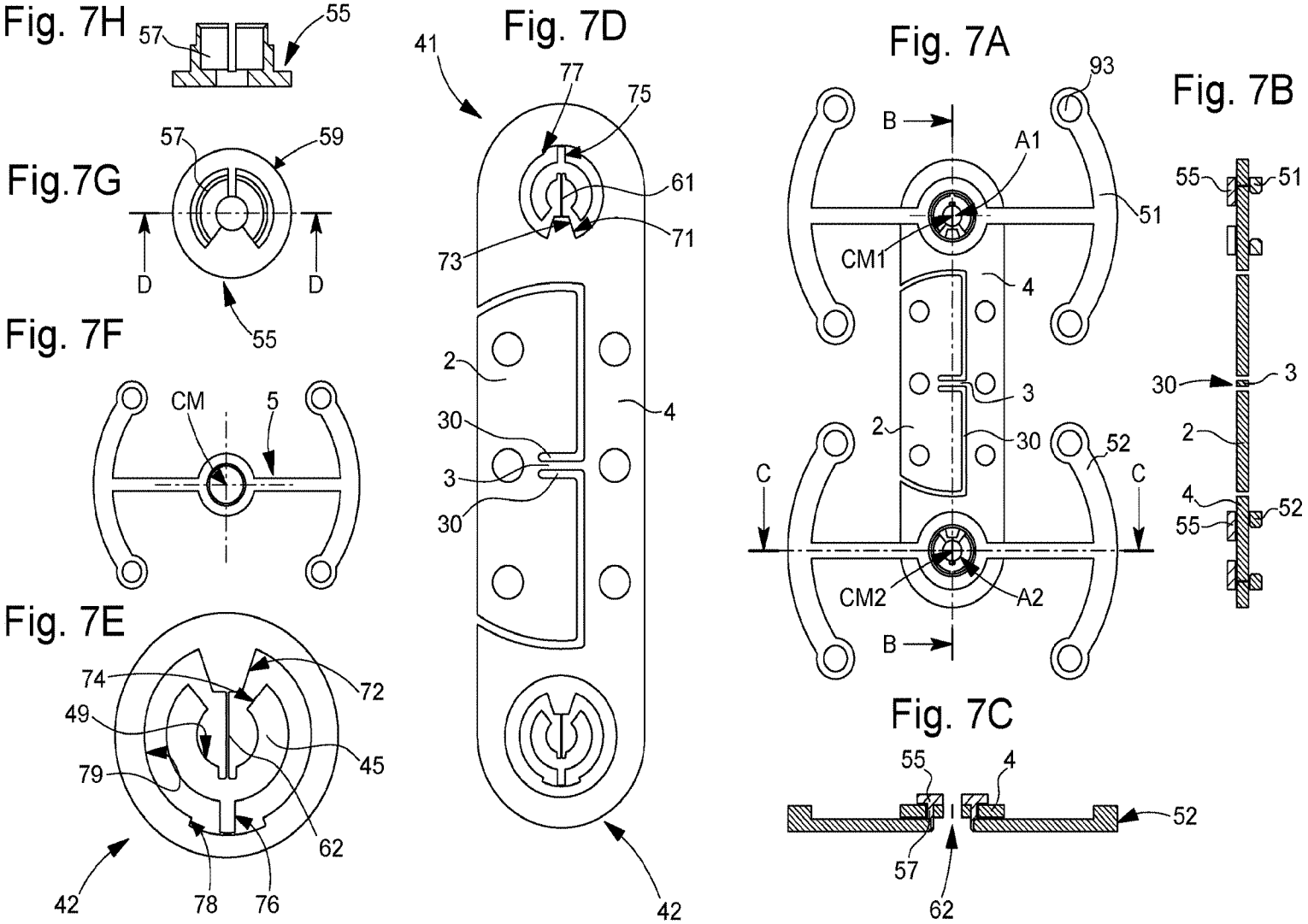

FIG. 6 illustrates an exploded view, with a localised detail, of an H-shaped tuning fork in a configuration similar to that of FIGS. 4 and 5, without arbors, and FIGS. 7A to 7H represent the components and the assembly of the H-shaped tuning fork of FIG. 6.

Figure 9:
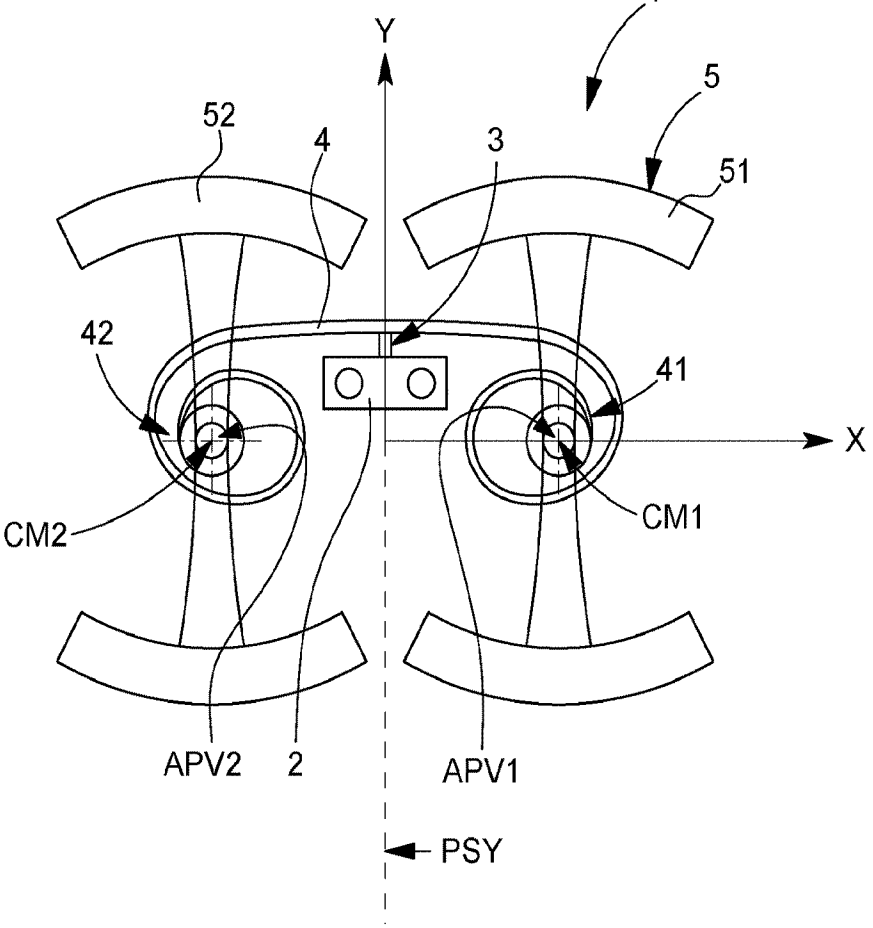
Figure 8:
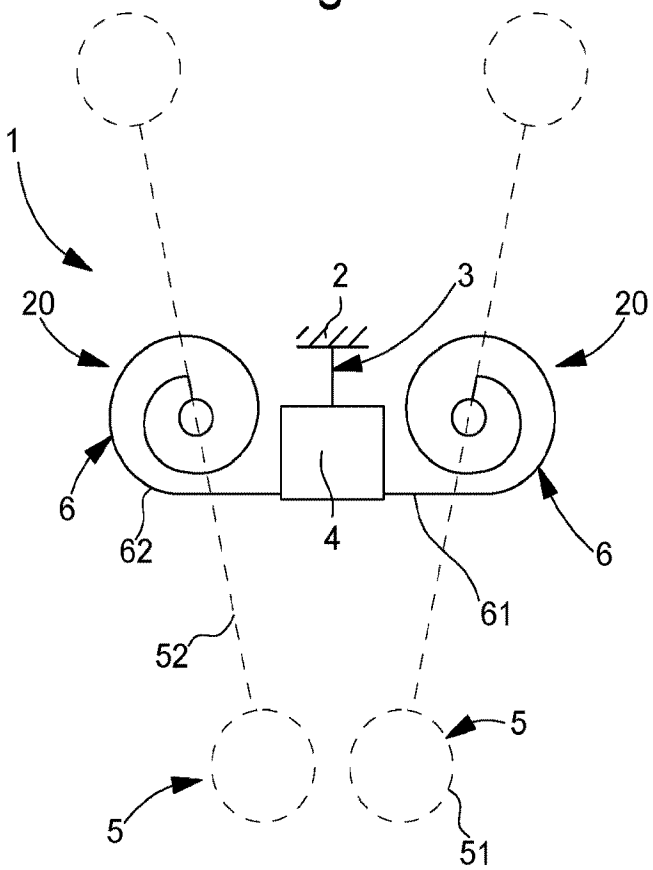

FIGS. 8 and 9 show schematic plan views of simplified versions of a second embodiment of the invention, called the "goat horn shaped tuning fork".

Figure 10:
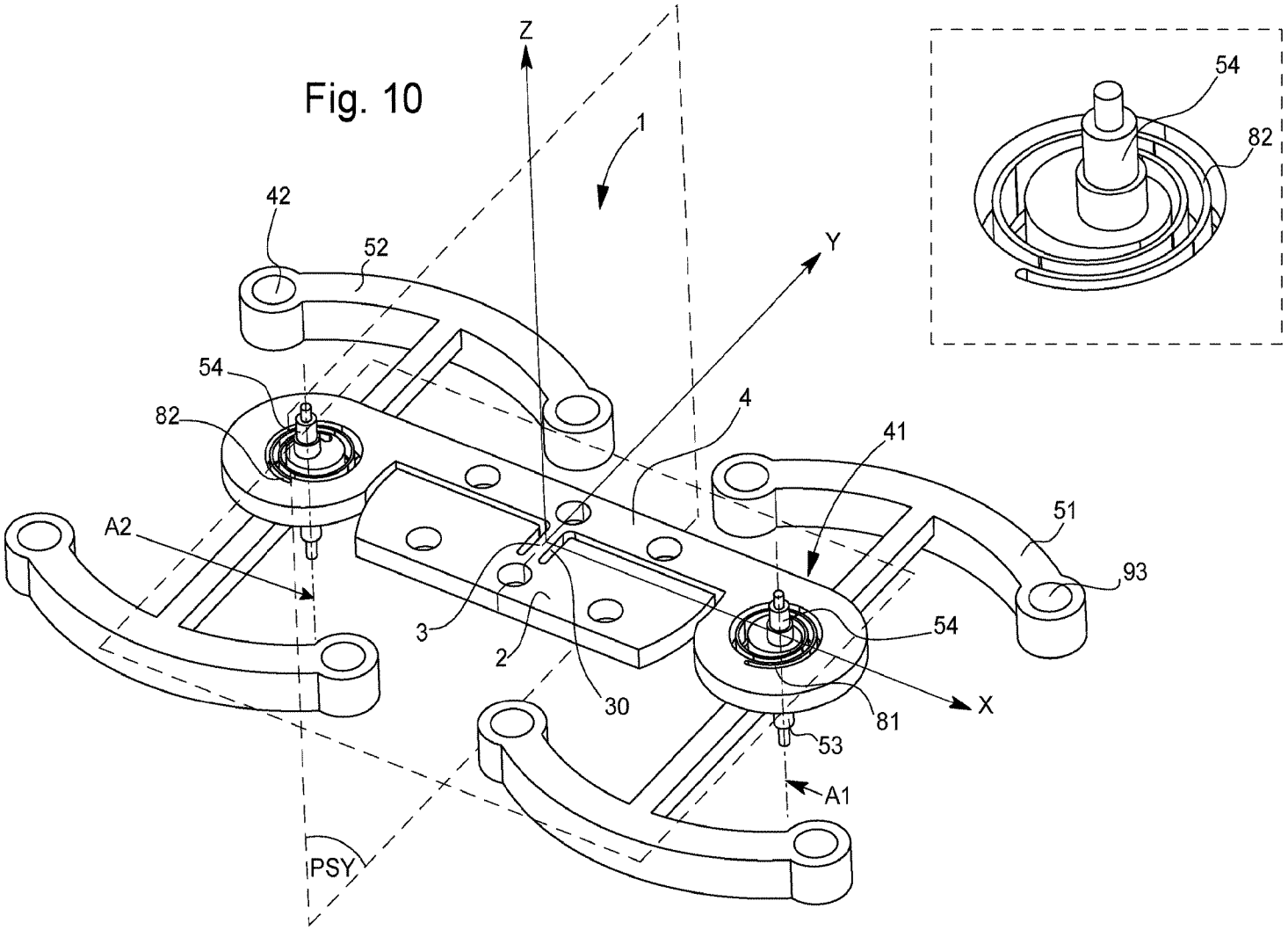

FIG. 10 shows a schematic perspective view, with a localised detail, of a more advanced variant of the goat horn shaped tuning fork.

Figure 11:
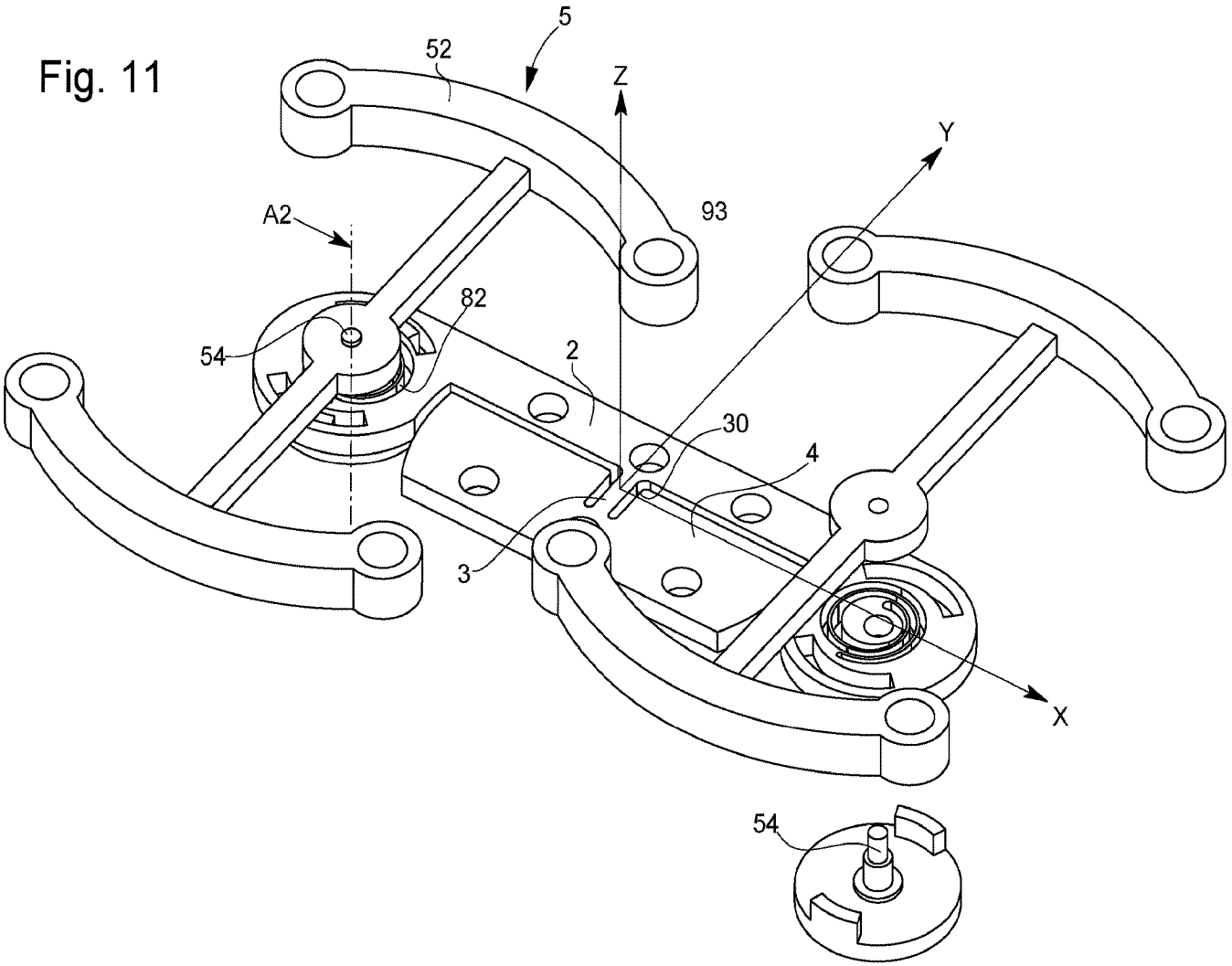
Figures 12A, 12B, 12C, 12D, 12E, 12F, 12G, 12H:
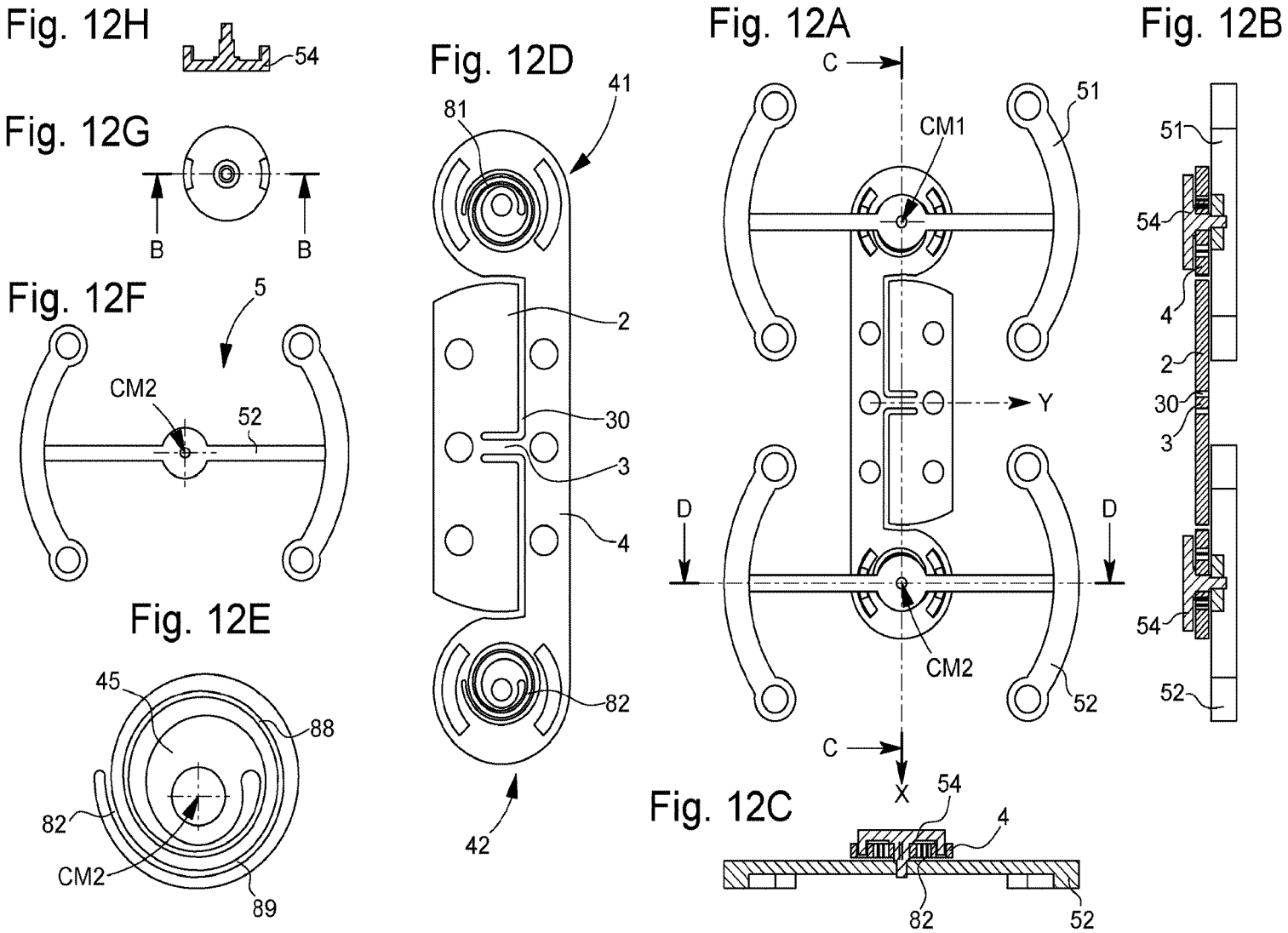

FIG. 11 illustrates an exploded view of a goat horn shaped tuning fork in a configuration similar to that of FIG. 10, without arbors, and FIGS. 12A to 12H represent the components and the assembly of the H-shaped tuning fork of FIG. 11.

FIGS. 13 and 14 show perspective and plan views of a torsional tuning fork which includes prongs, each provided with a weight at its distal end, oscillating in parallel planes and symmetrically with respect to an axis parallel to these two planes.

FIG. 15 illustrates another tuning fork variant with two resonators, each comprising a balance spring fixedly attached at a first end to a common crosspiece and comprising a weight at a second distal end, these two resonators extend in two parallel planes and, in projection onto one of these planes, are symmetrical with respect to a plane of symmetry which is perpendicular to said two planes.

FIG. 16 shows a schematic plan view of a mechanism similar to the goat horn shaped tuning fork of FIG. 8, which comprises, at each end of the crosspiece, a pair of balance springs both connected to the same respective weight at their inner coil, and attached to the respective crosspiece on either side of said weight.

FIGS. 17 and 18 are sketches illustrating surfaces cooperating by friction in the event of a drift; the friction increases with amplitude in the case of FIG. 18.

Figure 19:
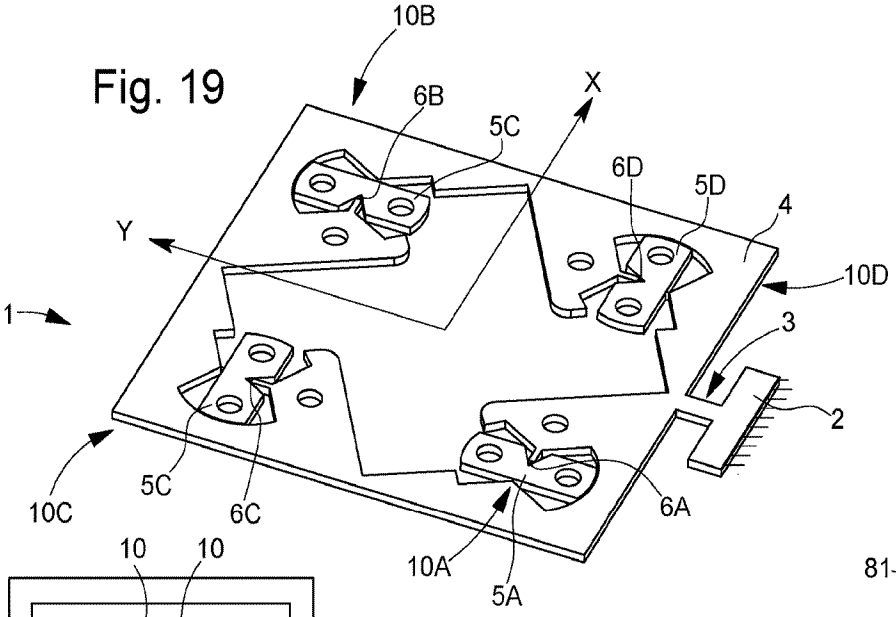

FIG. 19 shows a schematic perspective view, with a localised detail, of a variant wherein the crosspiece forms a frame surrounding the primary resonators, in an example application to four resonators.

Figure 20:
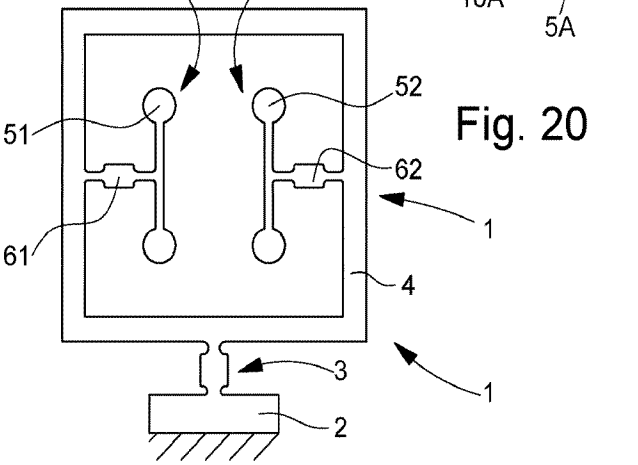

FIG. 20 shows a schematic plan view of another crosspiece variant formed by a frame, in an oscillator with straight strips, which is the counterpart to the H-shaped tuning fork.

Figure 21:
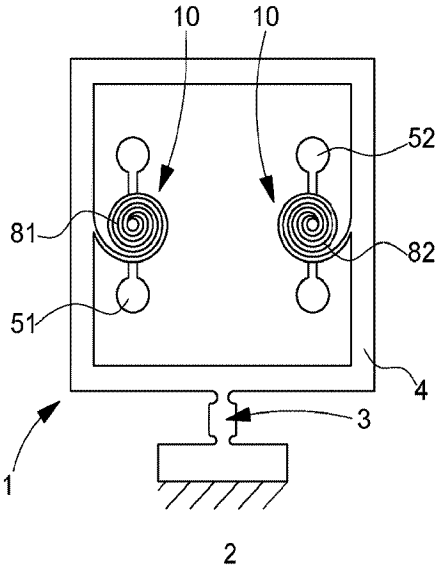

FIG. 21 shows a schematic plan view of another crosspiece variant formed by a frame, in an oscillator with balance springs, which is the counterpart to the goat horn shaped tuning fork.

FIG. 22 is a block diagram representing a watch including a movement incorporating an isochronous oscillator mechanism according to the invention.

Figure 23:
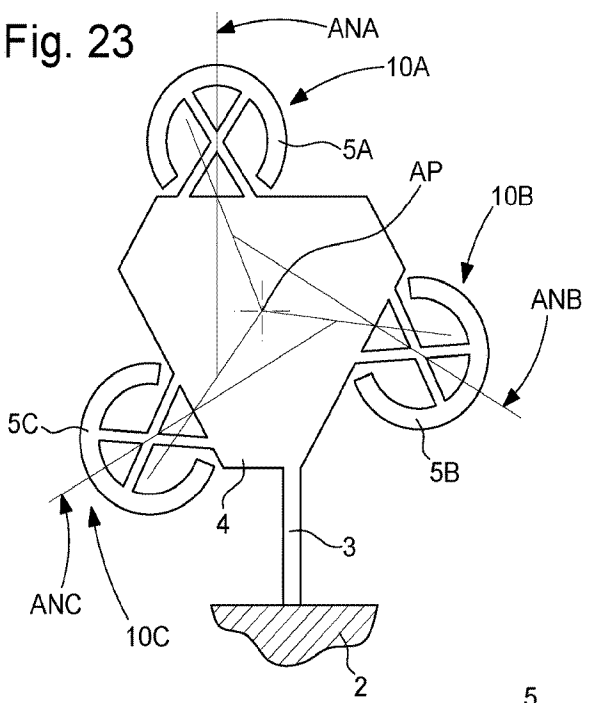

FIG. 23 shows a schematic, plan view of an oscillator comprising three primary resonators mounted in the shape of a star.

Figure 24:
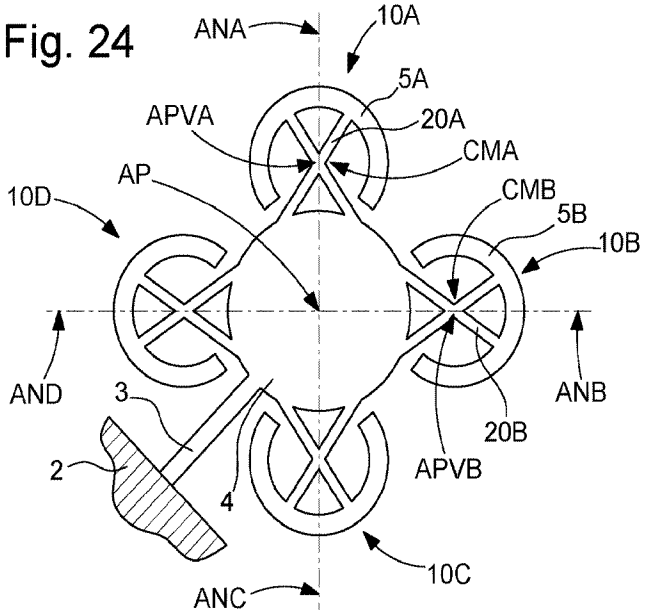

FIG. 24 shows a schematic plan view of an oscillator comprising four identical primary resonators mounted completely symmetrically with respect to each other.

Figure 25:
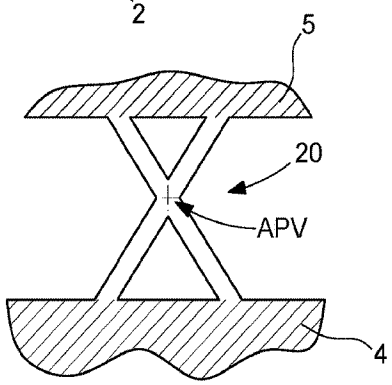

FIG. 25 shows a schematic, plan view of a detail of the crossed flat flexible bearing.

Figure 26:
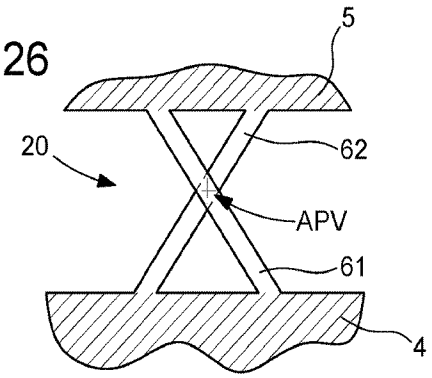

FIG. 26 shows a schematic plan view of a detail of the flexible bearing with two crossed strips disposed in two different parallel planes.

DETAILED DESCRIPTION OF PREFERRED EMBODIMENTS

The invention proposes to produce a resonator mechanism with the least possible energy losses, which has the least possible chronometric sensitivity to its orientation in the field of gravity.

The invention endeavours to reduce energy losses, notably due to pivot friction, and to movements of the point of attachment.

The inventive step consists in dispensing with the conventional pivots, while minimising the movements of the centre of mass and the reaction forces of the support.

A mechanical resonator necessarily includes at least one elastic element and one inertial element.

It is advantageous to use an elastic element to ensure the guiding function. This elastic element is then advantageously higher, thicker, and stiffer than an ordinary elastic element such as a balance spring or similar, which then leads to the preferred use of flexible strips.

It is advantageous to use rotating resonators, whose centre of mass coincides with the centre of rotation, which reduces the effect of gravity, and of shocks in the translational direction, on the accuracy of the resonator.

The desire for a high quality factor encourages the use of a tuning fork type structure.

However, losses must be minimised: indeed, during the operation of a resonator with flexible strips, the quality factor is good in the back and forth motion, but the torque reaction force at the point of attachment causes losses.

Thus, the inventive step consists in producing an isochronous tuning fork resonator, with a plurality of primary resonators disposed in a symmetrical geometry with respect to an axis, and together forming a tuning fork.

The use of several primary resonators decreases the resistance at the point of attachment, and averages out error.

To gain an additional order of magnitude improvement compared to the prior art, in insensitivity to position in space, the invention endeavours to achieve the least possible movement of the centre of mass of each primary resonator, which also provides very good insensitivity to shocks. To further the improvement, the invention proposes a structure designed with symmetries that compensate for any stresses applied to the point of attachment of the oscillator; to this end, it is advantageous for the U shape known in the prior art to be opened out to form a substantially H-shaped structure.

The invention is more particularly described below, in a non-limiting manner, in the preferred form of a tuning fork having two primary resonators symmetrical with respect to a plane of symmetry, which, because of its simplicity, constitutes a particularly advantageous case. However, the invention is applicable to any number N of primary resonators: three, four or more, provided that the symmetry of their arrangement and their relative temporal phase shift can compensate for the effects of the reaction torque at the point of attachment.

These primary resonators are mounted so as to have at least one identical resonance mode, and such that the resultant of the forces and torques at the fixed point of attachment is zero.

Thus, the invention concerns an isochronous timepiece oscillator mechanism 1 of the tuning fork type, comprising a fixed support 2 which bears a crosspiece 4 carrying a plurality of N primary resonators 10.

Each primary resonator 10 comprises at least one weight 5 carried by a rotating flexible bearing 20 fixed to crosspiece 4.

These primary resonators 10 are equivalent to the prongs of a conventional tuning fork, and crosspiece 4 is equivalent to the common part of the tuning fork from which the prongs project.

According to the invention, each primary resonator 10 has a centre of mass CM which is located, at rest, on the virtual pivot axis APV of rotating flexible bearing 20 comprised in primary resonator 10.

Each primary resonator 10 is arranged to oscillate in a rotating motion about virtual pivot axis APV.

The N primary resonators 10 are arranged in rotational symmetry of order N about a main axis AP which is parallel to all the virtual pivot axes APV which are parallel to each other.

And the oscillating movements of any two primary resonators 10 of oscillator mechanism 1 are phase shifted by the value of the central angle formed by their respective virtual pivot axes APV with respect to main axis AP.

In a particular embodiment, each rotating flexible bearing 20 is symmetrical, in projection onto a plane perpendicular to main axis AP, with respect to a plane of symmetry PS passing through the virtual pivot axis APV of the rotating flexible bearing 20 concerned.

More specifically, each plane of symmetry PS passes through main axis AP.

FIG. 24 illustrates an example oscillator 1 comprising four identical primary resonators 10 mounted completely symmetrically with respect to each other.

Advantageously, each rotating flexible bearing 20 is arranged to cause a return torque proportional to the angle of rotation of weight 5, or weights 5 if there are more than one, with respect to the virtual pivot axis APV of the rotating flexible bearing 20 concerned.

The use of rotating flexible bearings makes it possible to keep the centre of mass CM of each primary resonator 10 on virtual pivot axis APV of the rotating flexible bearing 20 concerned, or in immediate proximity thereto, for example in the event of a sharp acceleration or a shock.

Rotating primary resonators 10 surround crosspiece 4, and have at least one identical resonance mode, and are arranged to vibrate with a phase shift between them of value $2\pi/N$. Their symmetrical arrangement in space is such that the resultant of the forces and torques applied by primary resonator 10 to crosspiece 4 is zero.

Each rotating flexible bearing 20 forms an elastic return means, arranged to work by bending, and defines a substantially immobile virtual pivot axis APV.

In an advantageous embodiment, all of primary resonators 10 are identical to each other.

In a particular embodiment, crosspiece 4 is fixed to fixed support 2 by a resilient main connection 3, of greater stiffness than the stiffness of each rotating flexible bearing 20. This feature ensures the coupling between primary resonators 10. And, more specifically, the stiffness of this resilient main connection 3 is greater than the total stiffness of all the rotating flexible bearings 20 comprised in isochronous oscillator mechanism 1. In a particular embodiment, each primary resonator 10 is arranged to oscillate in a plane about a neutral axis AN. Advantageously, the damping of resilient main connection 3 is greater than the damping of each rotating flexible bearing 20, and, more specifically, the damping of resilient main connection 3 is greater than the total damping of all the rotating flexible bearings 20 comprised in primary resonators 10.

More specifically, and particularly when number N is an odd number, and all the neutral axes AN are concurrent at a single point, or concurrent in pairs at intersections all located at the same distance from main axis AP, as seen in FIG. 23 where oscillator 1 comprises three primary resonators 10 mounted in a star shape, each with a neutral axis tilted with respect to a radial line originating from main axis AP.

More specifically, all of neutral axes AN are shifted by an angle of value $2\pi/N$.

More specifically, and particularly when number N is an even number, all of neutral axes AN are parallel to each other or coincide.

In a particular embodiment, each flexible bearing 20 is symmetrical with respect to the neutral axis AN of the primary resonator 10 to which it belongs.

In a particular embodiment, the number of primary resonators 10 is an even number or the number is two.

In a particular embodiment, flexible bearing 20 comprises at least one flexible elastic strip 6 and its virtual pivot axis APV is in the middle of the flexible elastic strip 6, i.e. midway between the points of attachment of flexible strip 6 to crosspiece 4 and to the at least one weight 5.

In a particular embodiment, flexible bearing 20 comprises at least strips that are crossed in the same plane, as seen in FIGS. 23 to 25, or in projection as seen in FIG. 26.

In a particular embodiment, flexible bearing 20 comprises at least one neck portion of narrow section, as seen in FIG. 3.

In a particular embodiment, the number of primary resonators 10 is an even number or the number is two, and each flexible bearing 20 comprises at least one spiral winding around virtual pivot axis APV which is located on neutral axis AN of the primary resonator 10 to which it belongs. More specifically, in order to ensure symmetry of operation, the springs of these primary resonators 10 are disposed in pairs in a mirror arrangement.

In a particular embodiment, at least flexible bearing 20 is made of micromachinable material, or silicon and/or silicon oxide, or quartz, or DLC, particularly in the form of a one-piece component, especially when flexible bearing 20 is substantially flat. This one-piece component may also comprise a support for attaching weight 5 or weights 5, which are more particularly made of a material of higher density. This one-piece component may also be in one-piece with crosspiece 4, or with its resilient main connection 3, or with fixed support 2.

In an advantageous variant, each primary resonator 10 comprises temperature compensation means, at least on flexible bearing 20. Preferably, each weight 5 is devised such that the centre of mass CM remains invariant to temperature changes.

More specifically, these temperature compensation means comprise at least one component made of elinvar, or silicon and silicon oxide.

In an advantageous variant, at least one primary resonator 10 comprises backlash limiting means arranged to abuttingly engage in the event of a shock with complementary backlash limiting means, comprised in structure 2 and/or crosspiece 4. For example, a weight 5 comprises a finger that moves, during the oscillation of primary resonator 10, in an oblong groove of fixed support 2, or vice versa.

In a particular application, at least two primary resonators 10 are coupled to each other, at least intermittently, by an escape wheel. For example, each primary resonator 10 carries, on a weight 5, an arm whose distal end is arranged to cooperate with the toothing of the escape wheel.

In a particular embodiment, primary resonators 10 are each arranged to oscillate at a frequency comprised between 1 Hz and 100 Hz.

FIGS. 1 to 17 illustrate examples with two primary resonators, FIG. 19 illustrates an example with four primary resonators.

Primary resonators 10 are arranged in space such that the resultant of their errors of rate caused by gravity are zero.

Preferably, primary resonators 10 are rotating resonators, which makes isochronous oscillator 1 according to the invention virtually insensitive to gravity.

Thus, each primary resonator 10 forms a rotating resonator, whose centre of mass is located at a place subject to minimal translation during rotation, and where it is sought to achieve zero translation in normal operation. This is to minimise displacements of the centre of mass in the field of gravity or as a result of shocks, and, thereby, to improve the chronometry of the system.

Resilient main connection 3 between crosspiece 4 and fixed support 2 is preferably formed by an elastic strip; it hardly moves when isochronous oscillator mechanism 1 oscillates in tuning fork mode. Indeed, the branches of the tuning fork formed by primary resonators 10 exchange motion energy through crosspiece 4, but the motions of crosspiece 4 are tiny.

The direction in which the centres of mass CM of primary resonators 10 are mobile is called longitudinal direction X. A transverse direction Y is substantially perpendicular to this longitudinal direction X. A direction Z completes the direct trihedral.

In the variants illustrated in FIGS. 1 to 17, crosspiece 4 is straight and extends in longitudinal direction X.

In an advantageous but non-limiting embodiment, which corresponds to the variants illustrated by the Figures, all or part of isochronous oscillator mechanism 1 is arranged symmetrically with respect to a plane of symmetry PSY which extends parallel to transverse direction Y.

Preferably, but not necessarily, resilient main connection 3 extends in main direction Y, as seen in the examples of FIGS. 1 to 17.

In a particular embodiment, the primary direction which connects the point of attachment on crosspiece 4 of a flexible elastic strip 6 to the centre of mass CM of the corresponding primary resonator 10, when the latter is at rest, is parallel to longitudinal direction X.

Figure 1:
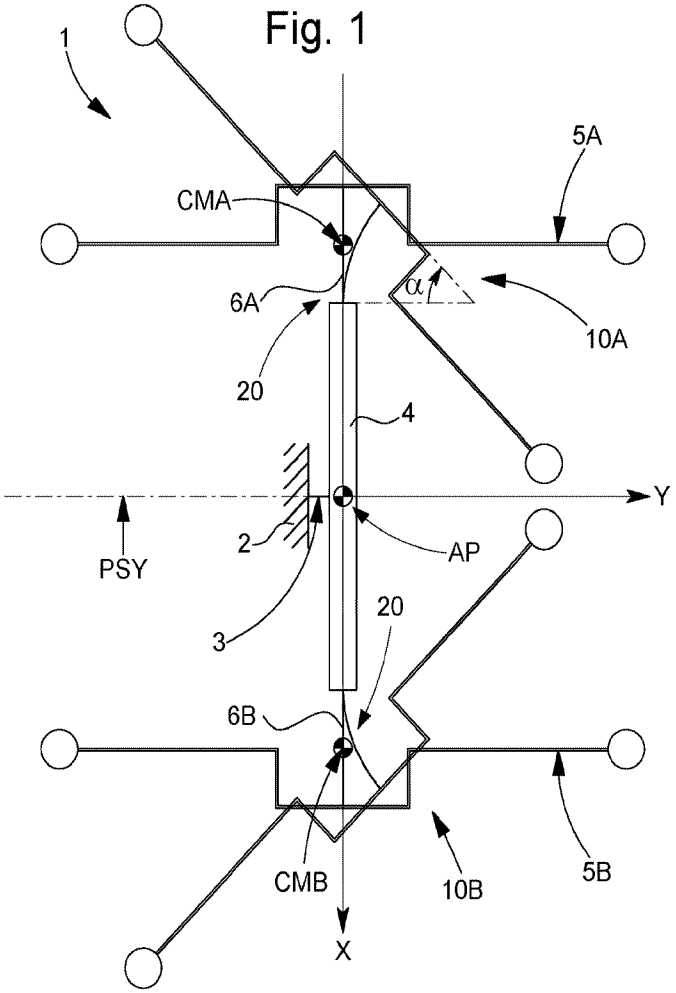
FIG. 1 shows a schematic plan view of an isochronous timepiece oscillator mechanism according to the invention, of the tuning fork type, comprising a fixed support which, via a main resilient connection, bears a crosspiece carrying two flat primary resonators, which are symmetrical with respect to a plane of symmetry and each comprise a weight carried by a flexible elastic strip that is arranged to work by bending and is fixedly attached to the crosspiece.

FIG. 1 illustrates a simplified embodiment of an isochronous timepiece oscillator mechanism 1 according to the invention, of the tuning fork type, comprising a fixed support 2 which, via a resilient main connection 3, made in the form of a flexible strip, bears a crosspiece 4 carrying two flat primary resonators 10A, 10B, which are symmetrical with respect to a plane of symmetry PSY, and each include a weight, respectively 5A, 5B, carried by a flexible elastic strip, respectively 6A, 6B, forming flexible bearing 20 of the primary resonator 10 concerned, arranged to work by bending and fixedly attached to crosspiece 4 symmetrically with respect to plane of symmetry PSY.

Selecting a geometric design symmetry makes adjustment easier. However, such an isochronous oscillator mechanism 1 may also be made with non-symmetrical primary resonators and still operate properly.

In the non-limiting variants of the invention illustrated by FIGS. 1, 3, 6, 8 to 11, the primary directions of the various primary resonators 10 which form isochronous oscillator mechanism 1 are parallel to or coincide with longitudinal direction X.

For maximum efficiency, flexible bearings 20, notably flexible elastic strips 6, are arranged such that the displacement of each centre of mass CM of a given primary resonator 10 is minimal in transverse direction Y where no compensation is provided, and such that the displacements of the various centres of mass CM of the given primary resonators 10 compensate for each other in longitudinal direction X: if, as in the case of the Figures, isochronous oscillator mechanism 1 comprises two primary resonators 10A and 10B disposed back-to-back on either side of crosspiece 4, their respective centres of mass CMA and CMB are essentially displaced in longitudinal direction X, with displacements of the same value but in opposite directions.

The advantage of an arrangement according to the invention is that the elastic strips work under almost pure bending, which makes it possible to obtain an isochronous resonator. The torque is proportional to the angle $\alpha$ whose corresponding weight 5 pivots. The frequency is thus independent of the amplitude of oscillation.

Preferably, the distance between the point of fixed attachment of the flexible elastic strip 6 in crosspiece 4 and centre of mass CM is equal to the distance between centre of mass CM and the point of fixed attachment of flexible elastic strip 6 in the associated weight 5, as seen in FIG. 1. The centre of mass CM therefore remains on axis X, or in immediate proximity to axis X, i.e. at a distance of a few micrometers.

In a particular embodiment, which permits economical manufacture, particularly by implementing micromachinable materials using MEMS, LIGA or similar processes, each primary resonator 10 is arranged to oscillate in a plane.

In a particular embodiment, each primary resonator 10 is monolithic.

In a particular embodiment, crosspiece 4 and flexible bearings 20, notably flexible elastic strips 6, of primary resonators 10 form a monolithic assembly.

In a particular embodiment, fixed support 2, resilient main connection 3, crosspiece 4, and flexible bearings 20, notably flexible elastic strips 6, of primary resonators 10, form a monolithic assembly.

Such an embodiment can provide flexible bearings 20, notably so-called "high sheet" elastic strips 6, which have a very large height relative to thickness, particularly which are at least five times higher than thick, and more specifically at least ten times higher than thick. Such high sheet strips make it possible to ensure the guiding function, and to dispense with conventional pivots, which allows for a significant increase in quality factor.

The tuning fork design according to the invention, compensates for any reaction forces at the points of fixed attachment, which also very substantially increases the quality factor.

In the embodiments illustrated by the Figures, weights 5, 51, 52 of primary resonators 10 are essentially subjected to a pivoting motion. The corresponding flexible bearing 20, particularly the corresponding flexible elastic strip 6, ensures the function of rotational support.

The invention is illustrated here in variants wherein, in each case, a single flexible elastic strip 6 holds the respective weight 5 relative to crosspiece 4. Other variants may be imagined wherein the number of strips 6 is doubled or multiplied to ensure even better support. However, the advantage of a single strip is that it works in pure bending, which eliminates shearing stress, or transverse forces, which hamper isochronism, which explains the preference for a single flexible strip 6, which therefore ensures improved chronometry for a watch incorporating an oscillator 1 according to the invention.

In the case of variants, as illustrated by the Figures, wherein each primary resonator 10 is arranged to oscillate in a plane, all of primary resonators 10 are arranged to oscillate in planes parallel to each other, or in the same plane.

More specifically, all of these primary resonators 10 are arranged to oscillate in the same plane, for example in the embodiments illustrated in FIGS. 1 to 12.

In particular embodiments, as seen in FIGS. 13 to 16, these primary resonators 10 each extend in a separate plane.

It is, however, possible to implement the invention with primary resonators 10 disposed differently in space.

FIGS. 1 to 12 illustrate an isochronous oscillator mechanism 1 whose primary resonators 10 are all identical, in an even number, and arranged symmetrically with respect to a plane of symmetry PSY extending parallel to a transverse direction Y which is that of resilient main connection 3 and perpendicular to a longitudinal direction X in which the centres of mass CM of primary resonators 10 are mobile.

Within each pair, primary resonators 10 oscillate in phase opposition, which ensures compensation for the movements of centres of mass CM in longitudinal direction X.

Preferably, resilient main connection 3 is straight.

In the variant of FIGS. 1 to 8, according to a first embodiment detailed below, flexible elastic strips 6 are straight, in longitudinal direction X. The centres of mass CM of the primary resonators 10 concerned are in alignment at rest. This arrangement ensures that isochronous oscillator mechanism 1 according to the invention is unaffected by positions in space, unlike a conventional tuning fork with parallel prongs which is far too sensitive to positions in space if it is incorporated in a watch, and which is only suitable for a clock.

Figure 2:
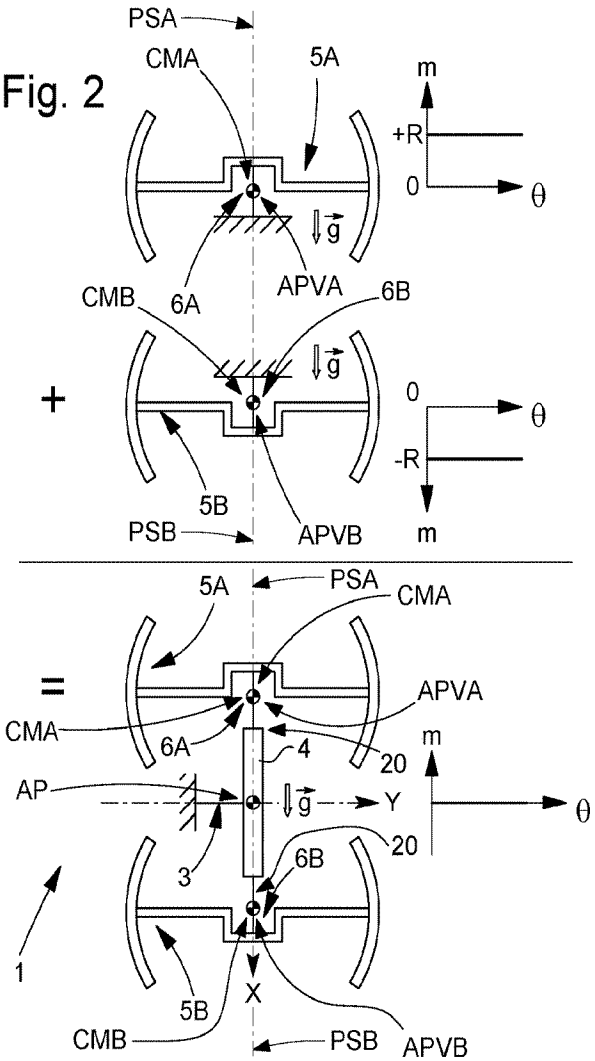
FIG. 2 simulates in a schematic manner.

The sketch of FIG. 2 explains the effect of gravity $\vec{g}$:

- in the top sketch, on a first weight suspended towards the top via a flexible strip, the rate diagram illustrates a losing rate of a certain value R,
- in the middle sketch, on a second identical weight suspended towards the bottom via an identical flexible strip, and the rate diagram corresponding to a gain in rate of the same value R,
- in the bottom sketch, on a mechanism according to the invention which combines the two preceding mechanisms, and the corresponding rate diagram which shows a gain or loss in rate close to zero, as a result of alignment in the opposite direction, which allows balancing, by averaging out the gain/loss of the two resonators forming the mechanism, thereby rendering the mechanism insensitive to position in space.

The residual defect, after compensating for movements of the centres of mass in direction X, has a very low value, on the same order of magnitude as the defect due to movements of the centres of mass in direction Y, which is limited to 3 or 4 micrometers, for a 1-millimeter-long strip, the cumulative defect thus remains less than 6 seconds per day.

The compensation achieved by the geometry of isochronous oscillator mechanism 1 according to the invention, in particular in an entirely symmetrical embodiment, thus reinforces the insensitivity to gravity achieved by the rotating operation of primary resonators 10. Symmetry therefore compensates for any residual error of rate.

Further, compensation of the forces and torques at the point of fixed attachment enables primary resonators 10 to oscillate for a very long time without damping.

In a particular variant of this first embodiment, flexible elastic strips 6 comprised in primary resonators 10 are straight and aligned in pairs.

In the variants of FIGS. 9 to 12, according to a second embodiment detailed below, flexible bearings 20 are formed by flexible elastic strips 6 in spirals, wound around centres of mass CM of the primary resonators 10 concerned.

A variant illustrated in FIGS. 13 and 14 represents a torsional tuning fork which comprises prongs 51 and 52, each provided with a weight at its distal end, and oscillating in parallel planes P1 and P2 and symmetrically with respect to an axis A parallel to these two planes P1 and P2.

Another tuning fork variant illustrated by FIG. 15 comprises two resonators, each including a balance spring attached at a first end to a common crosspiece and comprising a weight at a second distal end; these two resonators extend in two parallel planes and, in projection onto one of the planes, are symmetrical with respect to a plane of symmetry PS which is perpendicular to said two planes. The resulting torque is zero at the point of attachment on crosspiece 4.

It is understood that the invention allows for a large variety of geometric designs.

This is not without practical difficulties, since it is difficult to ensure the limited displacement of centres of mass CM of primary resonators 10 in transverse direction Y.

Further, the mechanisms must be able to be used in a watch, and incorporate safety devices, particularly shock resistant means.

Two particular embodiments, which are quite geometrically different, but both obey the logic of the invention, are presented hereinafter: a first H-shaped tuning fork embodiment, and a second goat horn shaped tuning fork embodiment.

The first H-shaped tuning fork embodiment is illustrated in FIGS. 1 to 7. Fixed support 2, resilient main connection 3, crosspiece 4, and flexible elastic strips 6 of primary resonators 10, together form a flat monolithic structure, made of silicon, or oxidised silicon, or quartz, or DLC or suchlike, which, in the rest position of isochronous oscillator mechanism 1 is symmetrical with respect to a plane of symmetry PS, and comprises a slender crosspiece 4 which extends in longitudinal direction X, perpendicular to resilient main connection 3, which extends in transverse direction Y, and which holds crosspiece 4 on fixed support 2.

This crosspiece 4 carries a pair of weights 5 referenced 51 and 52, mounted symmetrically on either side of fixed support 2 and of first resilient connection 3.

These weights 51, 52, extend substantially in transverse direction Y, forming the side bars of an H whose crosspiece 4 forms the horizontal bar. Preferably, each weight includes an arm connected at its middle to the corresponding flexible strip 6, this arm extending substantially in parallel in transverse direction Y, and being either a solid arm as in FIG. 3, or an arm comprising inertia blocks at its opposite ends, or at substantially isolated points as in FIG. 1, or in the form of annular sectors, as seen in FIGS. 2 and 4 to 7.

Each of these weights 51, 52 is mounted to oscillate about a virtual pivot axis of determined position with respect to crosspiece 4 and is returned by a flexible elastic strip 6, respectively referenced 61, 62, which forms elastic return means and which is integral with an end 41, 42 of crosspiece 4, the two ends 41 and 42 being opposite and on either side of crosspiece 4. These flexible strips 61, 62 preferably extend linearly in the extension of and on either side of crosspiece 4.

In the rest position of isochronous oscillator mechanism 1, each virtual pivot axis coincides with the centre of mass CM1, CM2 of the respective weight 51, 52.

These flexible elastic strips 61, 62 are arranged to limit the movement of centres of mass CM1, CM2, to a transverse travel with respect to crosspiece 4, which is as reduced as possible in transverse direction Y, and to a longitudinal travel in longitudinal direction X which is greater than said transverse travel.

As a result of symmetry and alignment, the longitudinal arrangement of flexible elastic strips 61, 62 can compensate for the direction of greatest displacement of centres of mass CM1 and CM2, which move symmetrically with respect to plane of symmetry PS.

Isochronous oscillator mechanism 1 according to the invention advantageously comprises rotational stops, and/or translational limit stops in directions X and Y, and/or translational limit stops in direction Z. These travel limiting means may be integral, form part of a one-piece structure and/or be added.

Weights 51, 52 advantageously include stop means 7, referenced 71, 72, which are arranged to cooperate with complementary stop means 73, 74 comprised in crosspiece 4, and limit the displacement of flexible elastic strips 61, 62 with respect to crosspiece 4, in the event of shocks or similar accelerations.

If a weight 5 is not directly carried by flexible strip 6, the latter comprises, on the other side to the main body of crosspiece 4, an end plate 45, which is arranged to receive, directly or indirectly, said weight 6. For example, the embodiment of FIGS. 4 and 5, like the variant of the second embodiment of FIGS. 11 and 12, comprises end portions 53, 54, arranged to be added to such an end plate 45 and to receive a weight 51 or 52. The variant of the first embodiment of FIGS. 6 and 7 comprises a bush 55 arranged to fulfil the same function.

In the variant of the first embodiment of FIGS. 4 and 5, the ends of crosspiece 4 each comprise two abutment surfaces 42, which are each arranged to stop an oblique surface 74 comprised in end plate 45, in order to limit the angle of deformation a (defined in FIG. 1) that flexible strip 6 can take with respect to its point of fixed attachment to crosspiece 4 and which thereby form rotational stops. The corresponding end of crosspiece 4 further includes a housing 79, notably a bore here, arranged to act as a limit stop for periphery 48 of the substantially circular end plate 45, to limit translations in directions X and Y. The result of these various stops, which limit translations in directions X and Y, is to limit the possible effect of shocks, to protect flexible strip 6, and to spare flexible strip 6 from any excessive deformation. Of course the possible displacement of centres of mass CM is also limited.

Stops in direction Z are provided mainly when end portions 53, 54, bushes 55 or suchlike are used; for example, FIG. 5 illustrates end portions 53, 54, which either comprise bores aligned with trunnions 56 carried by a plate, or comprise shoulders aligned with bores in a plate; the bearings thereby formed are contactless in normal operation, and are arranged to take up forces, notably in direction Z, in the event of shocks.

The detail of FIG. 6 represents, for the variant comprising a bush 55, a similar arrangement as regards the stops. End plate 45 also includes a lug with stop surfaces 76 arranged to cooperate in abutment with complementary surfaces 78 of crosspiece 4 to limit translations. Bush 55 has a skirt 57 pressed onto end plate 45, but the periphery 59 of bush 55 remains at a distance from bore 79 of crosspiece 4 and thus ensures therewith the safety by limiting translational motion in directions X and Y.

Shoulders in direction Z may also be arranged on some surfaces to form limit stop surfaces in direction Z.

Naturally, these arrangements to stop and limit the travel of flexible strip 6, like anti-shock means can be achieved in variants without an intermediate part; and particularly in the case where fixed support 2, resilient main connection 3, crosspiece 4 and primary resonators 1, including weights 5, form a monolithic assembly.

In the absence of unintended accelerations, such as shocks, the complementary stop surfaces must not be in contact with each other, to prevent any unnecessary friction detrimental to the quality factor.

Some travel limiting means may be used to fulfil the function of damping undesired vibration modes.

The illustrations of the first and second embodiment thus represent fixed support 2 and crosspiece 4 which are separated only by a narrow groove 30, called a "honey groove" here, around resilient main connection 3, which is devised to allow coupling in tuning fork mode. Groove 30 makes it possible to limit any angular movement of crosspiece 4, which is insignificant in normal mode, but which may occur in the event of shocks. Advantageously, this groove is filled with a viscous or paste-like product, which can dissipate energy in the case of excessive displacement.

This is particularly intended to prevent, or at least to limit the duration of operation in so-called "windshield wiper" mode, in which primary resonators 10 oscillate, not in phase opposition, but in-phase, since it is clear that compensation of the movements of the centres of mass is no longer assured in this in-phase oscillation mode, which also means that the oscillator is no longer isochronous.

Alternatively, or additionally, it is possible to add surfaces cooperating in direction Z with a solid or viscous or paste-like friction, which preferably increases with speed and/or with amplitude, for example with conical or corner surfaces, as seen in the sketches of FIGS. 17 and 18.

Preferably, flexible elastic strips 61, 62, which extend substantially in longitudinal direction X, are short strips, i.e. of a shorter length than the smallest value between four times their height or thirty times their thickness. It is this characteristic short strip which makes it possible to limit the movements of the centre of mass CM concerned.

In normal operation, there is no friction. Translational oscillation modes and displacements in the event of shocks are mechanically limited by arbors or suchlike.

In this configuration, the centre of mass CM of each primary resonator 10 hardly moves in transverse direction Y:

it makes a turning back movement, on either side of a mean axis parallel to longitudinal direction X, about a point located on this mean axis.

It is to compensate for this displacement of centre of mass CM along X that, according to the invention, flexible elastic strips 61 and 62 are preferably aligned, these strips preferably being straight.

The second embodiment of the goat horn tuning fork is illustrated in FIGS. 8 to 12. Fixed support 2, resilient main connection 3, crosspiece 4, flexible elastic strips 6 and end plates 45 of primary resonators 10 together form a flat monolithic structure, made of silicon, oxidised silicon, or quartz, or DLC, or similar, which, in the rest position of isochronous oscillator mechanism 1, is symmetrical with respect to a plane of symmetry PS, and comprises a slender crosspiece 4 which extends along longitudinal direction X, perpendicularly to resilient main connection 3, which extends in transverse direction Y and which holds crosspiece 4 on fixed support 2.

In a similar manner to the first embodiment, this crosspiece 4 carries a pair of weights 5 referenced 51 and 52, mounted symmetrically on either side of fixed support 2 and of first resilient connection 3. Each of these weights 51, 52 is mounted to oscillate and is returned by a flexible elastic strip 6 respectively referenced 61, 62, which is a balance spring 8 respectively 81, 82, or an assembly of balance springs. A first balance spring 81 and a second balance spring 82 are each connected at the inner coil thereof to an end plate 45 intended to receive a weight 51, 52, and attached to the respective end 41, 42 of crosspiece 4 by the outer coil.

Weights 51 and 52 each pivot about a virtual pivot axis of determined position with respect to crosspiece 4.

In the rest position of isochronous oscillator mechanism 1, each virtual pivot axis coincides with the centre of mass CM1, CM2 of the respective weight 51, 52.

In the same manner as in the first embodiment, weights 51, 52 extend substantially in transverse direction Y. Preferably, each weight includes an arm connected at its middle to the corresponding flexible strip 6, this arm extending substantially in parallel in transverse direction Y, and being either a solid arm as in FIG. 3, or an arm comprising inertia blocks at its opposite ends, or at substantially isolated points as in FIG. 8, or in the form of annular sectors, as seen in FIGS. 9 to 12.

To limit the displacement of centres of mass CM1, CM2, to a transverse travel with respect to crosspiece 4 which is as small as possible in transverse direction Y, and to a longitudinal travel in longitudinal direction X which is greater than said transverse travel, each balance spring 81, 82 has a variable section or curvature along its developed length.

The version illustrated by the Figures is a variant with variable thickness, optimised to limit the displacements of centres of mass CM. The weight 5 that oscillates is preferably suspended by a coil that is thicker than the rest of the balance spring.

Preferably, the development of the balance spring is greater than one turn, and especially greater than 1.5 turns, which makes it easier to minimise the movement of the centre of mass. For example, a regularly decreasing thickness over 270°, followed by an increase in thickness can limit the movement of centre of mass CM to 3 micrometers in direction Y and 4 micrometers in direction X. The basic polar stiffness advantageously passes through an extremum, for example one mini between two maxis or vice versa.

A satisfactory simulation also consists in giving the balance spring greater stiffness in the part 89 thereof outwardly beyond the centre of mass, than in the part 88 thereof comprised between the two centres of mass CM1 and CM2.

It is thus noted that the movements in direction X of centres of mass CM are smaller in this second embodiment with a balance spring than in the first embodiment with a straight strip.

It is, of course, possible to act on height rather than thickness to obtain a variable section: the choice of variable thickness makes MEMS development easier.

In short, an analogy can be drawn between this balance spring having variable characteristics and the Breguet or Grossmann terminal curve of a balance spring of a sprung balance assembly.

Once the movement of the centre of mass has been minimised, symmetrical mounting with respect to plane of symmetry PS provides excellent isochronism.

In normal operation, there is no friction: Translational oscillation modes and displacements in the event of shocks are preferably mechanically limited by arbors or by end portions 53, 54, or bushes 55.

Preferably, first balance spring 81 and second balance spring 82 are attached to ends 41, 42, in alignment with their respective virtual pivot axis, in the rest position of isochronous oscillator mechanism 1.

FIG. 16 illustrates another similar embodiment of the invention, wherein this diagram of the second embodiment is extrapolated by suspending each weight, not from a single balance spring, but from pairs of balance springs 81, 810, respectively 82, 820, attached to crosspiece 4, on either side of the centres of mass in direction Y. This very robust embodiment is, however, closer to a system of crossed flexible strips than the principle of the present invention.

FIG. 19 illustrates a variant wherein the crosspiece 4 forms a frame surrounding primary resonators 10 in an example application to four resonators 10A, 10B, 10C, 10D. It is understood that this inverse structure to the preceding examples can also be used to implement the invention, in all the variants set out above, and which are not, therefore, detailed further here.

FIG. 20 illustrates, in this variant of crosspiece 4 formed by a frame, an identical H-shaped tuning fork. The crosspiece 4 carries a pair 51, 52 of weights 5, mounted symmetrically inside crosspiece 4 which forms a frame suspended by first resilient connection 3 from fixed structure 2, weights 51, 52 extending substantially in transverse direction Y. Each of weights 51, 52 is mounted to oscillate about a virtual pivot axis of determined position with respect to crosspiece 4, and is returned by a flexible elastic strip 6, respectively 61, 62, which is integral on one side with the frame forming crosspiece 4, with flexible strips 61, 62 extending linearly inside the frame.

Likewise, FIG. 21 illustrates, in this variant of crosspiece 4 formed by a frame, an identical goat horn shaped tuning fork. Crosspiece 4 carries a pair 51, 52 of weights 5, mounted symmetrically inside crosspiece 4 which forms a frame suspended by first resilient connection 3 from fixed structure 2, and substantially in a transverse direction Y perpendicular to longitudinal direction X in which the centres of mass CM of primary resonators 10 are mobile. Each of weights 51, 52 is mounted to oscillate about a virtual pivot axis of determined position with respect to crosspiece 4, and is returned by a balance spring 8, respectively 81, 82, which is integral with one side of the frame forming crosspiece 4, with these balance springs 81, 82 extending inside the frame.

In the illustrated embodiments weights 5, 5A, 5B, 51, 52 form balance wheels.

Advantageously, in every embodiment, for the purposes of balance setting, inertia setting, and oscillation frequency adjustment, weights 51, 52 comprise inertia blocks 91, 92 and/or housings 93 for receiving such inertia blocks, preferably in the areas farthest from ends 41, 42 of crosspiece 4. Such inertia blocks advantageously comprise an off-centre insert, for example made of platinum, to facilitate adjustment by pivoting the insert. Naturally, particular areas of these weights 5 may be reserved for laser ablation, or, conversely, plasma, ink jet or similar loading, to perform these adjustments.

The invention also concerns a timepiece movement 100, particularly a mechanical movement, including at least one such isochronous oscillator mechanism 1.

The invention also concerns a watch 200 including such a mechanical movement 100.

In short, in its totally symmetrical version, the oscillator according to the invention consists of a tuning fork composed of two preferably rotating resonators, with flexure strips, mounted on a crosspiece connected, preferably viscoelastically, to the plate.

The elastic elements of each primary resonator 10 are devised to minimise the movement of centre of mass CM in transverse direction Y of the plane of symmetry PSY of the tuning fork.

Plane of symmetry PSY of the tuning fork is selected such that errors of rate due to positions in the longitudinal direction X perpendicular to transverse direction Y, are cancelled out by the two branches of the tuning fork formed by primary resonators 10, on either side of crosspiece 4.

The utilisation of rotating primary resonators makes it possible to limit the effect of translational accelerations (shocks and orientation in the gravitational field) on the rate of the resonator.

The tuning fork structure makes it possible to limit the effect of reaction forces at the points of fixed attachment.

To render the watch movement insensitive to position, the invention minimises the displacement of the centre of mass CM of each primary resonator 10.

For the second embodiment of the invention, called the goats horn tuning fork, the advantages are:

- strips in pure bending mode, hence isochronism:
- tuning fork structure, therefore zero reaction forces at the point of fixed attachment, and therefore a better quality factor;
- the elastic element formed by the flexible strip also performs the guiding function, therefore pivots are not required, therefore there is no friction, and therefore a better quality factor is obtained;
- variable and optimised thickness of the coil-shaped strip to limit undesired movements of the centre of mass in direction Y, hence a low error of rate in the vertical position of the watch:
- strips oriented such that the residual error of rate (due to vertical positions in longitudinal direction X) is cancelled out by the two strips of the tuning fork;
- integrated travel limitation, which provides high robustness, and prevents the strips breaking in the event of shocks in directions X, Y, Z or at $\alpha$;
- honey groove, for damping any windshield wiper oscillation mode that may occur in the event of a shock.

For the first embodiment of the invention, called the H-shaped tuning fork, the main features are similar, except as regards:

- the minimised strip length to limit undesired movements of the centre of mass in directions X and Y, which thus provides a low error of rate in vertical positions
- rectilinear flexible strips oriented along an axis perpendicular to the plane of symmetry of the tuning fork, so that the error due to vertical positions in longitudinal direction X, which is greater than the error in transverse direction Y wherein case, is cancelled out by the two strips of the tuning fork.

In short, the invention makes it possible to obtain a perfectly isochronous oscillator, which is very compact, requires no adjustment other than the inertia of the weights, and is very easy to assemble.

The invention claimed is:

1. An isochronous oscillator mechanism for horology developing substantially planarly, comprising:

- a fixed support which bears a crosspiece carrying a plurality of N primary resonators each comprising at least one weight carried by a rotating flexible bearing fixed to the crosspiece,
- wherein each primary resonator has a center of mass which is located, at rest, on the virtual pivot axis of the respective flexible bearing thereof, and wherein each primary resonator is configured to oscillate in a rotational motion about the virtual pivot axis,
- wherein the N primary resonators are configured in a rotational symmetry of order N about a main axis which is parallel to all the virtual pivot axes which are parallel to each other,
- wherein oscillating motions of any two of the primary resonators of the oscillator mechanism are phase shifted by the value of the central angle formed by the respective virtual pivot axes thereof with respect to the main axis, and
- wherein the flexible bearing comprises at least crossed strips, which are either crossed in a same plane, or whose projections onto a plane perpendicular to the main axis are crossed, and whose actual crossing or crossing in projection onto the plane perpendicular to the main axis defines the virtual pivot axis of the flexible bearing, and
- wherein the crosspiece is fixed to the fixed support by a resilient main connection, whose stiffness is greater than the stiffness of each rotating flexible bearing.

2. The isochronous oscillator mechanism according to claim 1, wherein each rotating flexible bearing is, in projection onto a plane perpendicular to the main axis, symmetrical with respect to a plane of symmetry passing through the virtual pivot axis of the rotating flexible bearing concerned.

3. The isochronous oscillator mechanism according to claim 2, wherein each plane of symmetry passes through the main axis.

4. The isochronous oscillator mechanism according to claim 1, wherein each rotating flexible bearing is configured to cause a return torque proportional to the angle of rotation of the at least one weight with respect to the virtual pivot axis of the rotating flexible bearing concerned.

5. The isochronous oscillator mechanism according to claim 1, wherein the primary resonators have at least one identical resonance mode.

6. The isochronous oscillator mechanism according to claim 1, wherein all of the primary resonators are identical to each other.

7. The isochronous oscillator mechanism according to claim 1, wherein each primary resonator is configured to oscillate in a plane about a neutral radial axis, and wherein all of the neutral radial axes are concurrent at a single point or concurrent in pairs at intersections that are all located at a same distance from the main axis.

8. The isochronous oscillator mechanism according to claim 7, wherein a number of the primary resonators is an even number or the number is two, and wherein all of the neutral axes are, in pairs, parallel to each other or coincide.

9. The isochronous oscillator mechanism according to claim 1, wherein the flexible bearing comprises at least one flexible elastic strip, and wherein the virtual pivot axis is in the middle of the flexible elastic strip.

10. The isochronous oscillator mechanism according to claim 1, wherein a number of the primary resonators is an even number or the number is two, and wherein the flexible bearing of each primary resonator comprises at least one balance spring, the balances springs of the primary resonators are in a mirror arrangement in pairs.

11. The isochronous oscillator mechanism according to claim 1, wherein at least the flexible bearing is made of micromachinable material, or of silicon and/or silicon oxide, or of quartz, or of DLC.

12. The isochronous oscillator mechanism according to claim 1, wherein each primary resonator comprises temperature compensation means at least on the flexible bearing.

13. The isochronous oscillator mechanism according to claim 12, wherein the temperature compensation means comprises at least one component made of elinvar or of silicon and silicon oxide.

14. The isochronous oscillator mechanism according to claim 1, wherein at least two of the primary resonators are coupled to each other, at least intermittently, by an escape wheel.

15. The isochronous oscillator mechanism according to claim 1, wherein the primary resonators are each configured to oscillate at a frequency between 1 Hz and 100 Hz.

16. A timepiece movement comprising at least one isochronous oscillator mechanism according to claim 1.

17. A watch comprising at least one movement according to claim 16.

18. An isochronous oscillator mechanism for horology developing substantially planarly, comprising:

a fixed support which bears a crosspiece carrying a plurality of N primary resonators each comprising at least one weight carried by a rotating flexible bearing fixed to the crosspiece, wherein each primary resonator has a center of mass which is located, at rest, on the virtual pivot axis of the respective flexible bearing thereof, and wherein each primary resonator is configured to oscillate in a rotational motion about the virtual pivot axis, wherein the N primary resonators are configured in a rotational symmetry of order N about a main axis which is parallel to all the virtual pivot axes which are parallel to each other, wherein oscillating motions of any two of the primary resonators of the oscillator mechanism are phase shifted by the value of the central angle formed by the respective virtual pivot axes thereof with respect to the main axis, and wherein the flexible bearing comprises at least crossed strips, which are either crossed in a same plane, or whose projections onto a plane perpendicular to the main axis are crossed, and whose actual crossing or crossing in projection onto the plane perpendicular to the main axis defines the virtual pivot axis of the flexible bearing, and wherein the flexible bearing includes at least one neck portion of narrow section.

19. An isochronous oscillator mechanism for horology developing substantially planarly, comprising:

a fixed support which bears a crosspiece carrying a plurality of N primary resonators each comprising at least one weight carried by a rotating flexible bearing fixed to the crosspiece, wherein each primary resonator has a center of mass which is located, at rest, on the virtual pivot axis of the respective flexible bearing thereof, and wherein each primary resonator is configured to oscillate in a rotational motion about the virtual pivot axis, wherein the N primary resonators are configured in a rotational symmetry of order N about a main axis which is parallel to all the virtual pivot axes which are parallel to each other, wherein oscillating motions of any two of the primary resonators of the oscillator mechanism are phase shifted by the value of the central angle formed by the respective virtual pivot axes thereof with respect to the main axis, and wherein the flexible bearing comprises at least crossed strips, which are either crossed in a same plane, or whose projections onto a plane perpendicular to the main axis are crossed, and whose actual crossing or crossing in projection onto the plane perpendicular to the main axis defines the virtual pivot axis of the flexible bearing, and wherein at least one of the primary resonator comprises backlash limiting means to cooperate in abutment in event of shocks with complementary backlash limiting means comprised in the fixed support and/or the crosspiece.

* * * * *